United States Patent [19]

Jingu et al.

[11] Patent Number: 4,990,003

[45] Date of Patent: Feb. 5, 1991

[54] PAPER FEED MECHANISM FOR DOT MATRIX PRINTER

[75] Inventors: Toshihiro Jingu, Hiratsuka; Ryuji Yamazaki, Isehara; Kazunori Matsumoto, Fujisawa, all of Japan

[73] Assignee: NCR Corporation, Dayton, Ohio

[21] Appl. No.: 384,200

[22] Filed: Jul. 24, 1989

[30] Foreign Application Priority Data

Sep. 16, 1988 [JP] Japan ..... 63-230161

[51] Int. Cl.[5] ..... B41J 11/20

[52] U.S. Cl. ..... 400/56; 400/636; 271/273

[58] Field of Search ..... 400/636, 636.1, 637.1, 400/638, 639, 639.1, 641, 56, 600, 600.2; 226/124; 101/292, 297, 306, 287, 93.04, 93.05; 271/273, 274

[56] References Cited

U.S. PATENT DOCUMENTS

| | | | |
|---|---|---|---|
| Re. 28,897 | 7/1976 | Natori . | |
| 1,453,581 | 5/1923 | Armstrong . | |
| 3,072,397 | 1/1963 | Kelchner | 271/274 |
| 3,837,461 | 9/1974 | Waibel . | |
| 3,868,008 | 2/1975 | Brumbaugh | 400/56 |
| 4,056,183 | 11/1977 | Beery | 101/93.05 |
| 4,061,332 | 12/1977 | Baumgartel et al. | 271/274 |
| 4,173,420 | 11/1979 | Okabe | 400/636.1 |
| 4,573,816 | 3/1986 | Pamler . | |
| 4,620,807 | 11/1986 | Polit | 271/274 |
| 4,699,367 | 10/1987 | Russel | 271/274 |
| 4,762,314 | 9/1988 | Harada | 271/274 |
| 4,763,575 | 8/1988 | Miciukiewicz | 271/274 |
| 4,850,584 | 7/1989 | Watashi | 271/274 |
| 4,867,058 | 9/1989 | Luckhurst | 101/93.05 |

FOREIGN PATENT DOCUMENTS

| | | | |
|---|---|---|---|
| 3340046 | 5/1985 | Fed. Rep. of Germany | 400/56 |
| 610701 | 10/1960 | Italy | 400/639.1 |
| 0059878 | 4/1983 | Japan | 400/56 |

OTHER PUBLICATIONS

"Printer Paper Bail Rollers" IBM Tech. Disclosure Bulletin, vol. 18, No. 11, (Apr. 1976) p. 3537.

"Spring Loaded Round Patent" IBM Technical Disclosure Bulletin, vol. 26, No. 4, 9/83, pp. 1834–1835.

*Primary Examiner*—Eugene H. Eickholt

*Attorney, Agent, or Firm*—Wilbert Hawk, Jr.; Albert L. Sessler, Jr.; George J. Muckenthaler

[57] ABSTRACT

A mechanism for feeding record media from a supply roll through a printing station. The printing station includes printing means and a platen assembly operable for printing on the record media. A feed roller is supported by the platen assembly and is movable therewith in a direction to and from the printing means. A pressure roller is supported in opposed manner to said feed roller and the pressure roller is journaled in bearings in frame plates. The bearings include elongated slots therein for the shaft of the pressure roller to enable the pressure roller to move a predetermined distance into the path of the record media from the supply roll and to guide the record media along a path to avoid contact with the printing means.

9 Claims, 8 Drawing Sheets

PRIOR ART

PRIOR ART

PAPER FEED MECHANISM FOR DOT MATRIX PRINTER

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and for journal printing operations, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like record media while the carriage and print head are moved above and across the form or like record media in the horizontal direction.

Further, in the wire matrix printer which is utilized for receipt, slip and journal printing operations, the individual print heads may be vertically oriented and printing performed by means of the print wires moving downwardly to impact on the record media. Alternatively, the individual print heads may be horizontally oriented and printing performed by means of the print wires moving horizontally to impact on the record media. A preferred number of four of such individual print heads is common in known arrangements. The dot matrix printer is commonly used in an electronic cash register (ECR) or in a point of sale (POS) terminal.

In the dot matrix printer, there is a requirement for one or more small electric motors to drive certain parts of the printer. A small motor is used to drive the print head carriage in reciprocating manner in the printer that includes a stationary platen and a movable print head. The print head carriage and the associated print head are moved to appropriate and precise locations along the line of printing for dot matrix printing of alpha numeric characters or of graphics type characters. A second motor is used to drive the paper such as a receipt, a slip or a journal at the end of the printing operation and which paper drive is usually performed at the end of each line of printing. However, it is feasible to advance the paper at the end of the printing on a line without the necessity of moving the carriage and print head to the end of such line. This arrangement enables faster printing operation.

Additionally, in the dot matrix printer which is used for receipt, slip and journal printing operations, the receipt paper is advanced from a supply roll past the receipt/slip printing station and is cut after each receipt printing operation and a receipt is given to the customer. A slip is inserted at the front of the printer, printing is performed on the slip at the receipt/slip printing station, and the slip is then withdrawn from the printer.

Representative documentation in the field of paper feed mechanisms includes U.S. Pat. No. 1,453,581, issued to F. H. Armstrong on May 1, 1923, which discloses a lever for rocking a feed roll shaft from a platen.

U.S. Pat. No. 3,837,461, issued to H. K. Waibel on Sept. 24, 1974, discloses a platen and a pressure roller, spring loaded by springs and urged into engagement with record media by a pressure block.

U.S. Pat. No. Re 28,897, issued to M. Natori on July 13, 1976, discloses a trigger mechanism in combination with a rotating drum and slidable members to convert the rotation of the drum into linear motion.

U.S. Pat. No. 4,573,816, issued to G. Pamler on Mar. 4, 1986, discloses elastic bearings formed for constraining movement of a shaft in one direction.

SUMMARY OF THE INVENTION

The present invention relates to a dot matrix printer for impact printing on record media. The dot matrix printer includes two separate printing stations, one station positioned near the front of the printer and the other station positioned rearwardly of the one station. The two stations are arranged in tandem manner and the two separate print head carriages are coupled to a drum cam type drive mechanism positioned between the two carriages. The two carriages along with the associated print heads are driven by the drum cam type drive mechanism an equal distance in opposite directions during printing operations.

The one station near the front of the printer is utilized for dot matrix printing on a receipt and on a slip or like business form and is referred to as the receipt/slip printing station. The other station rearwardly of the one station is utilized for dot matrix printing on a journal and is referred to as the journal printing station. A plurality of solenoid driven, single wire print heads are supported in spaced relationship on each carriage for performing the printing operations at the two printing stations.

A single drum type cam drive is positioned between the receipt/slip station and the journal station. The drum cam includes a rail on the periphery thereof which engages with a pair of rollers on each print head carriage. Rotation of the drum cam in a predetermined direction causes the receipt/slip print head carriage to move in one direction across the printer and causes the journal print head carriage to move an equal distance in the opposite direction.

A receipt paper roll is disposed rearwardly of the receipt/slip station and receipt paper is driven across the platen for printing on the paper. A knife mechanism is provided at the front of the printer for cutting the receipt paper after printing thereon. The printer also includes a slip table positioned for receiving a slip for printing thereon at the receipt/slip station.

In accordance with the present invention, there is provided a paper feed mechanism for a dot matrix printer having side plates and comprising a printing station having a platen assembly and opposed printing elements operably associated therewith for printing on receipt paper, a feed roll carried by the platen assembly and drive means for rotating the feed roll to advance receipt paper past the printing station, a pressure roll opposed and cooperating with the feed roll for enabling the receipt paper to advance past the printing station, bearing means supported by the side plates for journaling the pressure roll, the bearing means defining an elongated aperture therein permitting the pressure roll to be moved away from the feed roll, and means operably associated with the platen assembly for moving the platen assembly and the feed roll in a direction toward the pressure roll, the length of said elongated aperture in the moving direction of the feed roll being less than the distance moved by the feed roll.

In view of the above discussion, a principal object of the present invention is to provide an improved paper feeding mechanism for a dot matrix printer.

Another object of the present invention is to provide a paper feeding mechanism which is constructed to positively drive receipt paper past the printing station of the dot matrix printer.

An additional object of the present invention is to provide a platen and feed roll assembly wherein the assembly is moved in a direction from the printing elements to define a path for the receipt paper so as to avoid contact with such printing elements.

A further object of the present invention is to provide a paper feeding mechanism having a feed roll and a pressure roll which is movable in an elongated slot in a bearing and the feed roll is movable in a downward direction from the pressure roll to enable the pressure roll to move down and to guide the receipt paper in a path to avoid the printing elements and thereby reduce jams of the receipt paper and prevent damage to the printing elements.

Still another object of the present invention is to provide a feed roll arrangement adjacent a printing station that includes a platen and opposed printing elements and wherein the feed rolls are moved simultaneously with the platen to guide receipt paper in a path to avoid contact of the receipt paper with the printing elements or with a ribbon associated with the printing station.

Additional advantages and features of the present invention will become apparent and fully understood from a reading of the following description taken together with the annexed drawing.

DESCRIPTION OF THE PREFERRED EMBODIMENT

Figure 1:
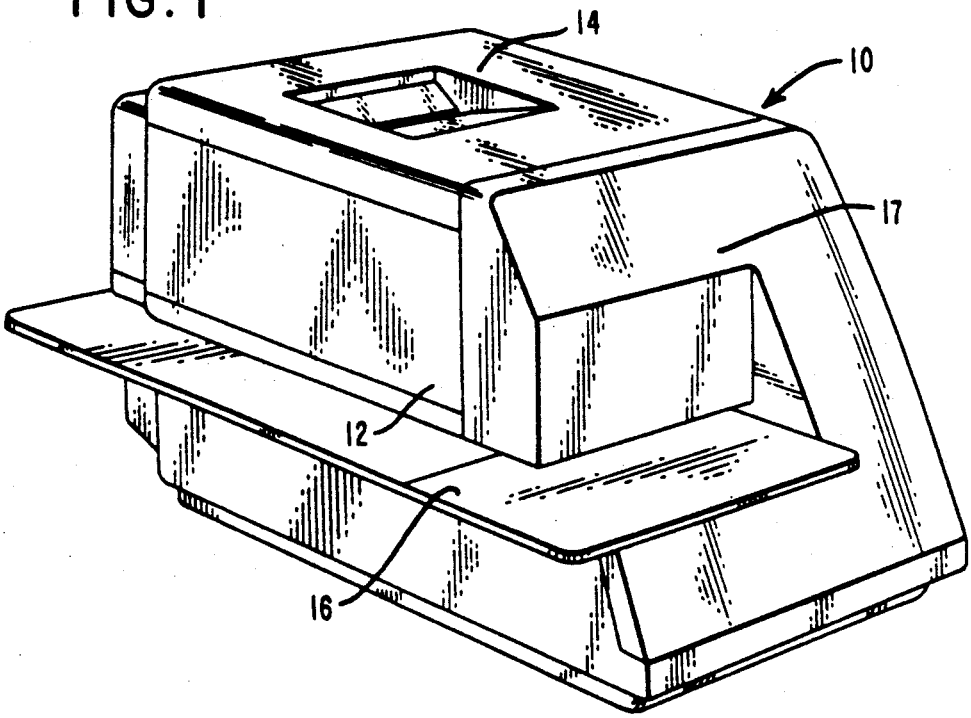
FIG. 1 is a perspective view of a dot matrix printer incorporating the subject matter of the present invention.

Referring now to FIG. 1, a printer 10 is designed as a two station, receipt/slip and journal printer. The receipt/slip printing station occupies a front portion 12 and the journal printing station occupies a rearward portion 14 of the printer. A slip table 16 is provided along the left hand side of the printer 10. A front cover 17 swings toward the right to expose certain operating parts of the printer 10.

Figure 2:
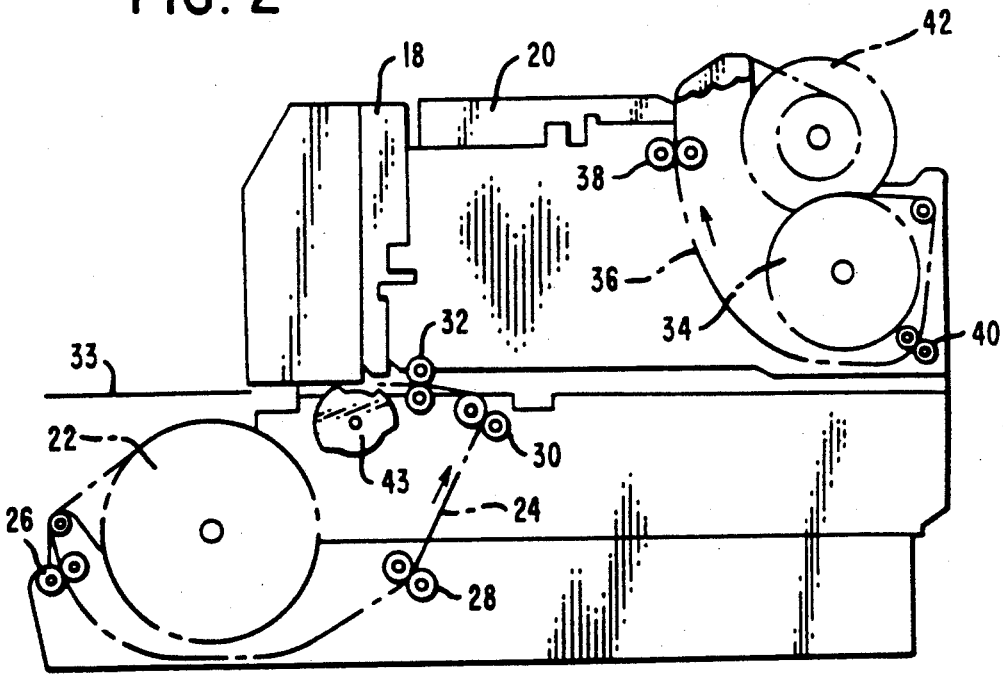
FIG. 2 is a right side elevational view in diagrammatic form showing the arrangement of certain elements of the printer.
Figure 3:
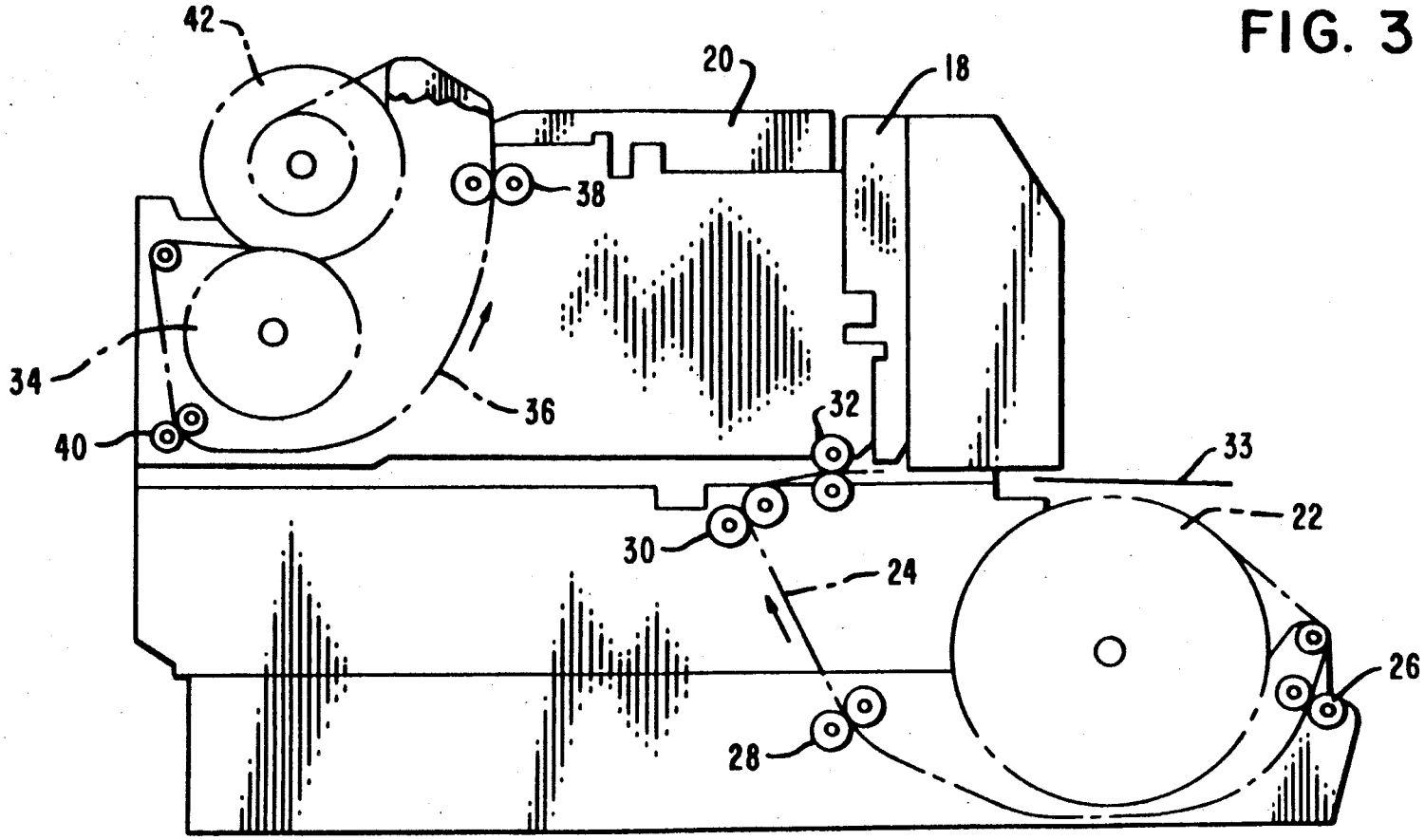
FIG. 3 is a left side elevational view in diagrammatic form showing the arrangement of such certain elements of the printer.

FIGS. 2 and 3 are right and left side elevational views and show certain elements of the printer 10 in diagrammatic form. The receipt/slip portion 12 and the journal portion 14 include individual print wire solenoids (not shown) along with a ribbon cassette 18 for the receipt/slip printing station operation and a ribbon cassette 20 for the journal printing station operation. A roll 22 of receipt paper is journaled at the front of the printer and the receipt paper 24 is driven and guided by appropriate pairs of rollers, as 26, 28, 30 and 32 in a path past the receipt/slip printing station for printing operation and for issuance of a receipt 33 after cutting thereof from the receipt paper 24. A supply roll 34 of journal paper is positioned in a cradle at the rear of the printer 10 and the journal paper 36 is driven and guided by appropriate pairs of rollers, as 38 and 40, in a path from the supply roll 34, past the journal printing station, and onto a take-up roll 42. A timing plate 43 (FIG. 2) is provided at the receipt/slip printing station for positioning the receipt/slip feed rolls.

Prior to describing the structure and function of the present invention, it should be noted that the printing station is designed to accommodate both receipt paper 24 and a slip or form 55 (FIG. 4) which may include a plurality of sheets or plies of paper. When a slip or form 55 is inserted into the printer 10, the various elements of the printing station are operated to accommodate the slip or form 55 for the printing operation. In this regard, appropriate drive rolls 31 and 32 (FIG. 4) are actuated to advance the slip or form 55 from the front of the printer 10 in one direction and into position for printing at the printing station and then to reverse the drive rolls 31 and 32 to move the slip or form 55 in the opposite direction and out of the printer 10 after the printing operation.

When it is desired to print on the receipt paper 24, certain elements of the printer 10 are operated to advance or drive the receipt paper 24 from the supply roll 22 along a path therefrom, toward and through the printing station for the printing operation. It is necessary to guide the end of the receipt paper 24 in the path and through the printing station without contact of such end with certain elements of the printing station so as to provide free flow of the receipt paper 24 and to avoid jams in the printing operation.

Figure 4:
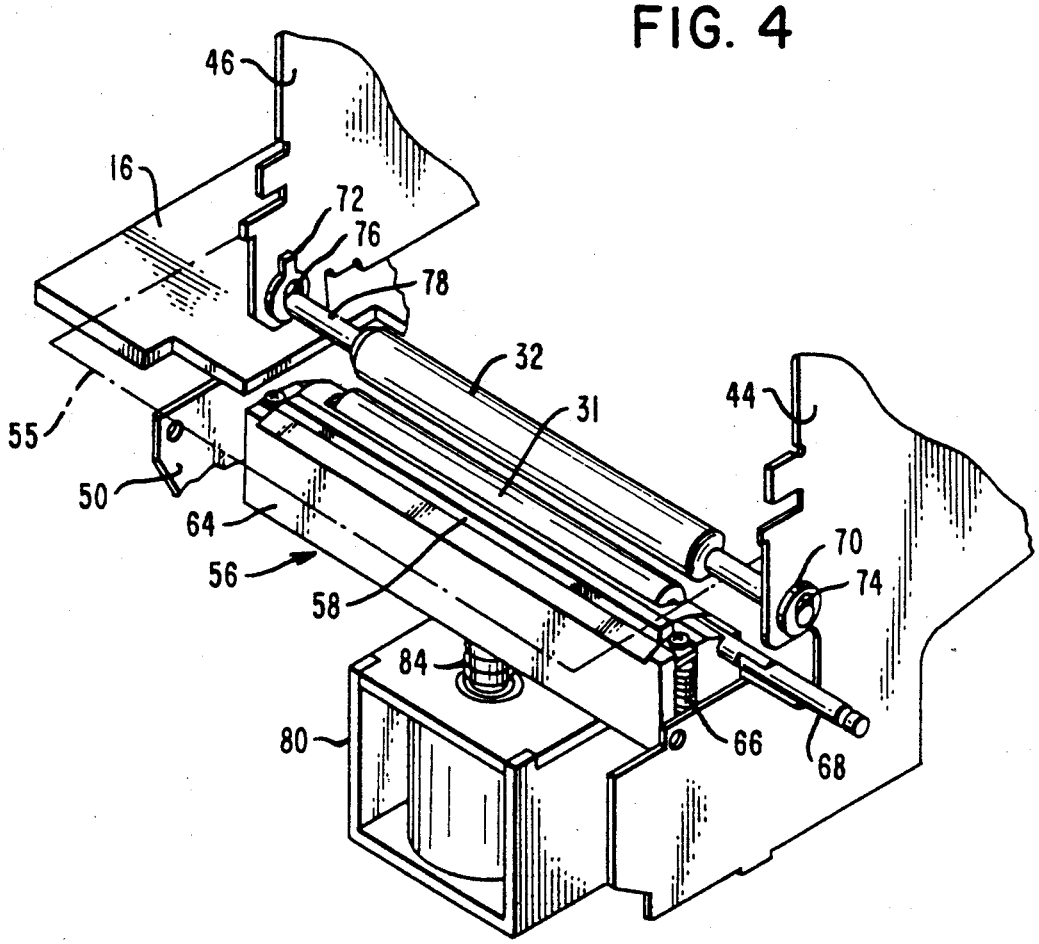
FIG. 4 is a perspective view, taken from the front and right side, of a portion of the dot matrix printer illustrating the parts of the paper feeding mechanism.
Figure 5A:
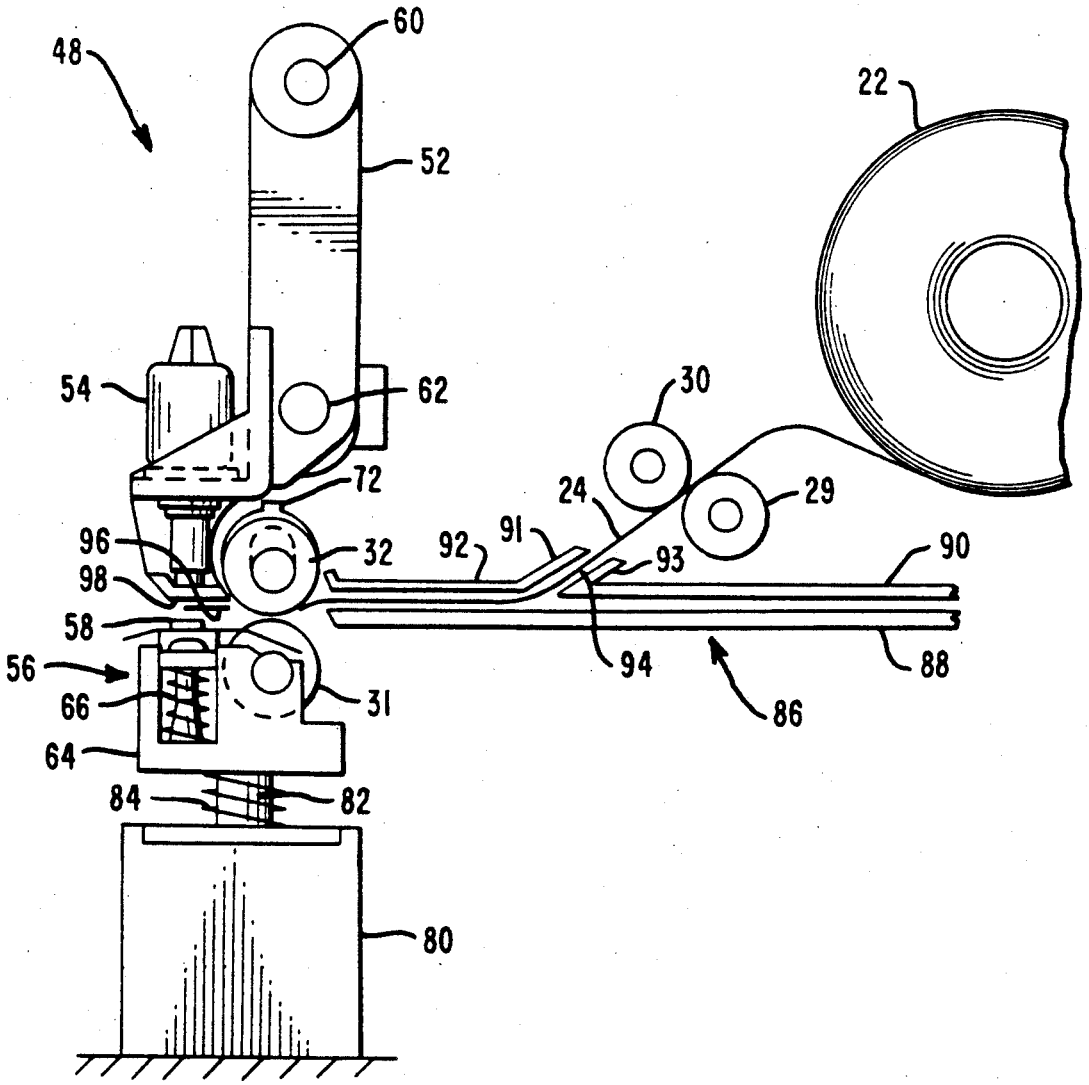
FIGS. 5A and 5B are right side elevational views, showing the arrangement of the paper feeding mechanism in paper guiding and paper feeding positions, respectively.
Figure 5B:
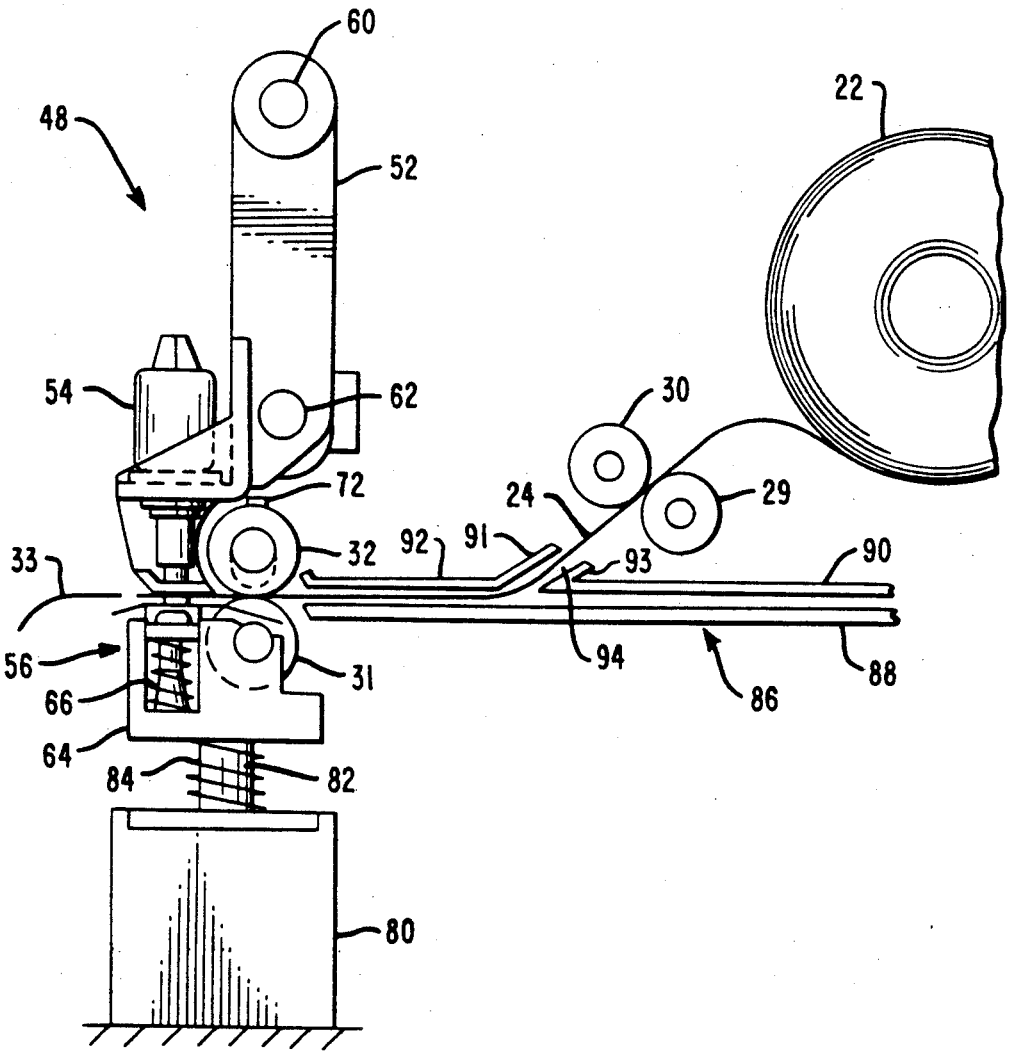

Referring now to FIGS. 4, 5A and 5B, the printer 10 includes side plates 44 and 46, the side plate 46 being above the slip table 16. The slip table 16 is suitably secured to a lower side wall 50 (FIG. 4). A space is provided between the side wall 46 and the slip table 16 to permit insertion of a slip 55 (shown in phantom in FIG. 4) into the printer 10 for printing operation. A receipt/slip printing station, generally designated as 48 in FIGS. 5A and 5B, includes a print head carriage 52 carrying a plurality of print heads 54. A platen assembly, designated generally as 56, includes a platen 58 (FIG. 5A) positioned in opposed relationship to the print heads 54. It is understood, of course, that a ribbon (not shown) is positioned between the lower ends of the print heads 54 and the receipt paper 24 for use in the printing operation. The carriage 52 is supported on spaced shafts 60 and 62 and is driven in transverse manner on the printer 10 by a drum type cam (not shown).

The platen assembly 56 has a structure 64 (FIGS. 4, 5A and 5B) that is supported at each end thereof by a spring 66. The platen assembly 56 also includes the paper drive or feed roll 31 which is journaled in structure 64 for rotation and is positively driven by suitable drive means (not shown). The feed roll 31 includes a shaft portion 68 (FIG. 4) extending through the side plate 44 for coupling with such suitable drive means.

The pressure roll 32 is positioned in opposed relationship with the feed roll 31 and a pressure roll shaft 78 is journaled in bearings 70 and 72 (FIG. 4) in the side plates 44 and 46. Each bearing 70 and 72 has an elongated slot, as 74 and 76, respectively, and of semicircular configuration at the ends of the slot to receive the shaft 78 of the pressure roll 32.

A solenoid 80 has an armature shaft 82 (FIGS. 5A and 5B) operably associated with the support structure 64 of the platen assembly 56 and includes a coil spring 84 around the shaft 82. The solenoid 80 is operated to move the platen assembly downward and to provide a space between the print heads 54 and the platen 58 (FIG. 5A).

In the arrangement of the receipt paper supply roll 22 and the receipt/slip printing station 48, as illustrated in FIGS. 5A and 5B, a main guide structure 86 is provided at the rear of the printing station 48 (to the right in FIGS. 5A and 5B) to provide a main feed path for both the receipt paper 24 and for the slip 55. The guide structure 86 includes a lower guide plate 88 and a pair of upper guide plates 90 and 92. The upper guide plates 90 and 92 are positioned so that the ends 91 and 93 of the guide plates 90 and 92 form a second guide structure 94 to provide an entry or sub feed path at the confluence of the second guide structure 94 with the main guide structure 86 for the receipt paper 24 from the supply roll 22. The feed rolls 29 and 30 are suitably journaled in the printer and advance the receipt paper 24 through the entry path of the second guide structure 94 and along the main path or guide structure 86 toward the printing station 48.

Figure 6A:
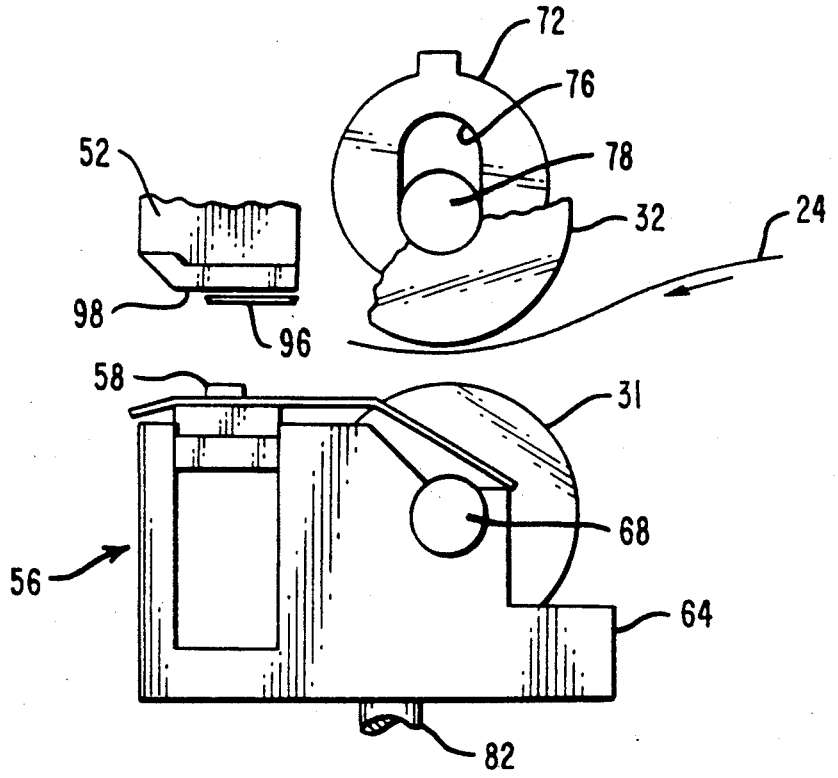
FIGS. 6A and 6B are right side elevational views showing parts of the structure of FIGS. 5A and 5B in enlarged manner.
Figure 6B:
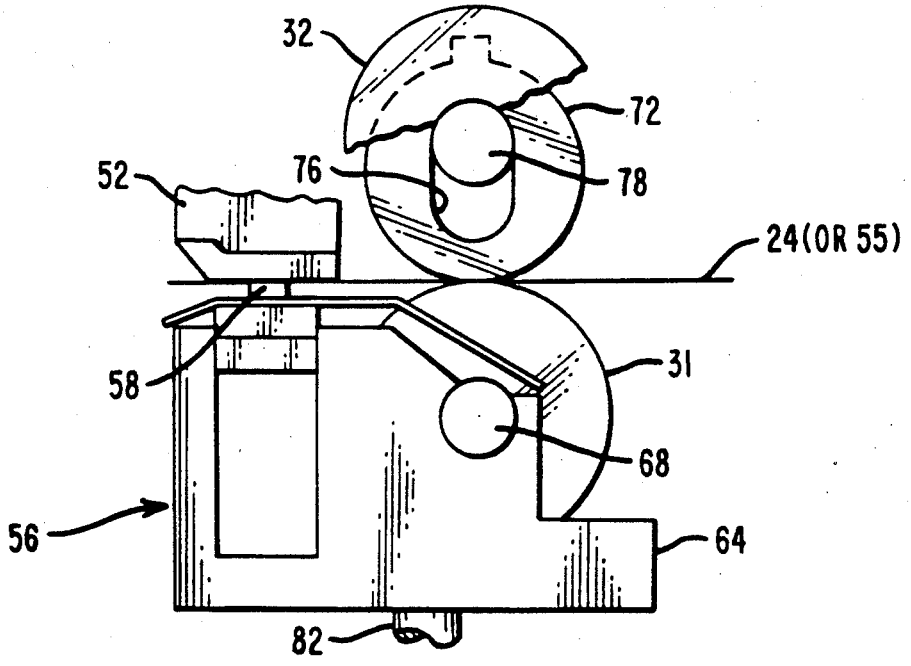

FIGS. 6A and 6B are enlarged views of the platen assembly 56 showing the support structure 64 with the feed roll 31 and the pressure roll 32 in two positions adjacent the printing station 48. The lower edge portion 98 of the carriage 52 is shown in opposed relationship to the platen 58, it being noted that the ends of the print wires of the print heads 54 (FIGS. 5A and 5B) are on a plane substantially with the edge portion 98 and that a ribbon 96 is suitably positioned between the ends of the print wires and the platen 58 (FIG. 6A).

In the operation of the paper feed mechanism of the present invention, it is assumed that the solenoid 80 is actuated to move the platen assembly 56 away from the print heads 54 (FIG. 5A), that a slip 55 has been inserted to the proper position for printing thereon by the print heads 54, the solenoid 80 is again actuated to release the slip 55, and that the slip has been removed from the printing station 48. During the time of printing on the slip 55, the feed rolls 29 and 30 retract the receipt paper 24 into the entry or sub feed path of the second guide structure 94. When the slip 55 is removed from the printing station 48, the pressure roll 32 drops by reason of the shaft 78 moving into the lower portion of the elongated slots 74 and 76 in the bearings 70 and 72 (FIG. 4). The feed rolls 29 and 30 are driven to advance the receipt paper 24 to the main feed path formed by the main guide structure 86 and toward the receipt/slip printing station 48. It is seen from FIG. 6A that the lowering of the pressure roll 32 in the bearings 70 and 72 (FIG. 4) blocks the straight path of the receipt paper 24 through the printing station and guides the forward end of the paper into a position that is below the lower edge portion 98 of the carriage 52.

When the receipt paper 24 is advanced to a predetermined position for the printing operation, the solenoid 80 is deenergized and the platen assembly 56 is moved up to a printing position by the coil spring 84 on the armature shaft 82. At the same time, the pressure roll 32 is moved up to a position wherein the shaft 78 occupies the upper portion of the elongated slots 74 and 76 (FIGS. 4, 5B and 6B). The platen 58 is then positioned relative to the print wires of the print heads 54 and to the ribbon 96 for printing on the receipt paper 24, as the carriage 52 is moved in transverse manner on the printer 10. The feed roll 31, the pressure roll 32 and the feed rolls 29 and 30 operate to advance the receipt paper 24 past the printing station 48 (FIG. 5B). When the printing operation is completed, the receipt paper 24 is cut by cutting mechanism (not shown) and a receipt 33 (FIG. 5B) is provided to the customer.

When it is desired to perform a printing operation on a slip or form 55, the receipt paper 24 is retracted from the printing station 48 and from the main feed path formed by the guide structure 86 to the sub feed path formed by the guide structure 94. The solenoid 80 is energized and the platen assembly 56 is moved down to permit insertion of the slip 55 along the slip table 16 and into position at the printing station 48 for the printing operation. After insertion of the slip 55 into the area of the printing station 48, the solenoid is deenergized and the spring 84 moves the platen assembly 56 upward to the printing position. The slip 55 is advanced to the desired printing position on the slip by the feed roll 31 and the pressure roll 32, as seen in FIG. 6B. The pressure roll 32 is tapered at the slip insertion side thereof (FIG. 4) to facilitate insertion of the slip. After the printing operation on the slip 55, the slip is driven by the feed roll 31 and the pressure roll 32 out the front of the printer (to the left in FIG. 5A).

In the case wherein a single printing station is used to print on two kinds of record media, it is necessary to remove from the printing station one record medium on which printing has been completed and to position the other record medium at the printing station for printing operation. The printer includes means for advancing the receipt paper 24 or the slip 55 and also means for retracting the receipt paper and the slip 55 in their respective directions relative to the printing station 48. FIG. 6B shows the receipt paper 24 or a slip 55 being held in position by the rollers 31 and 32 for the printing operation.

Figure 7A:
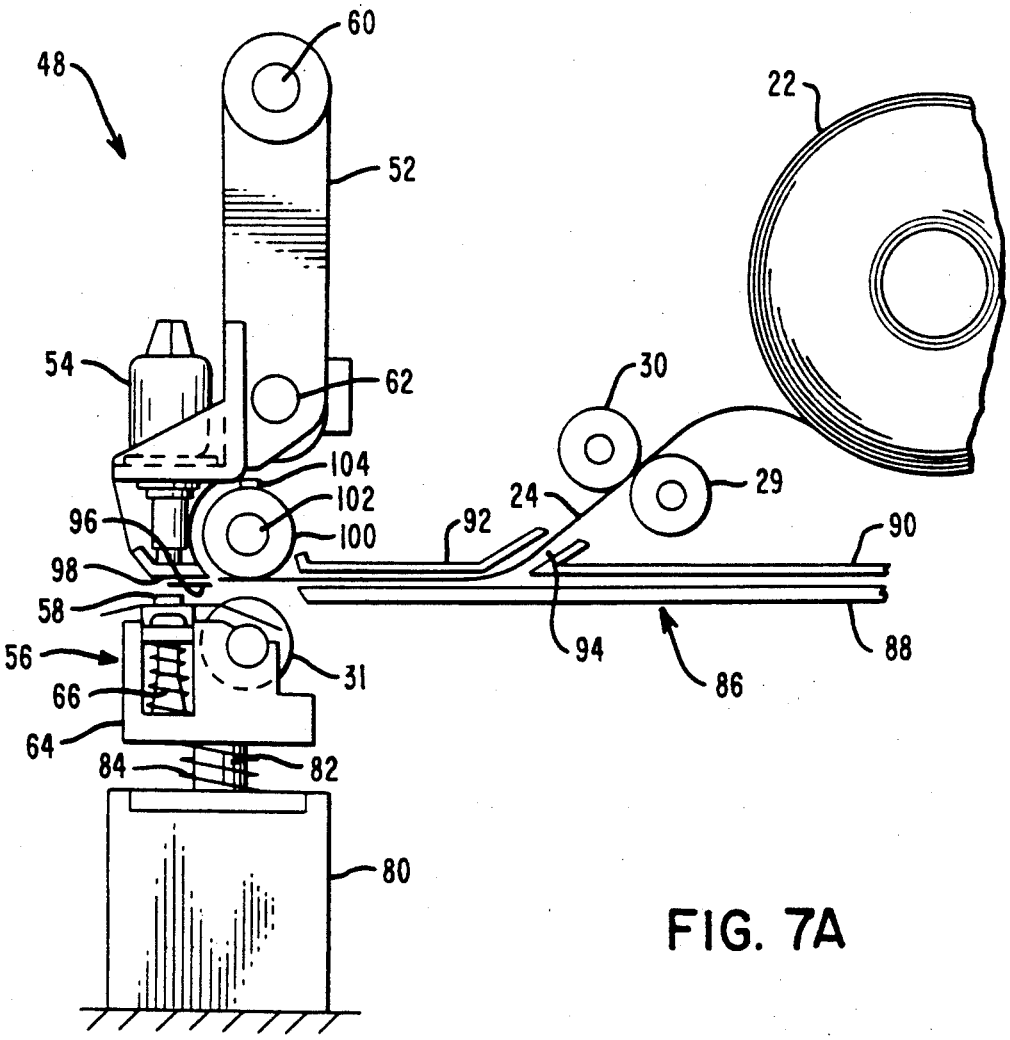
FIGS. 7A and 7B are side elevational views of a conventional paper feeding mechanism.
Figure 7B:
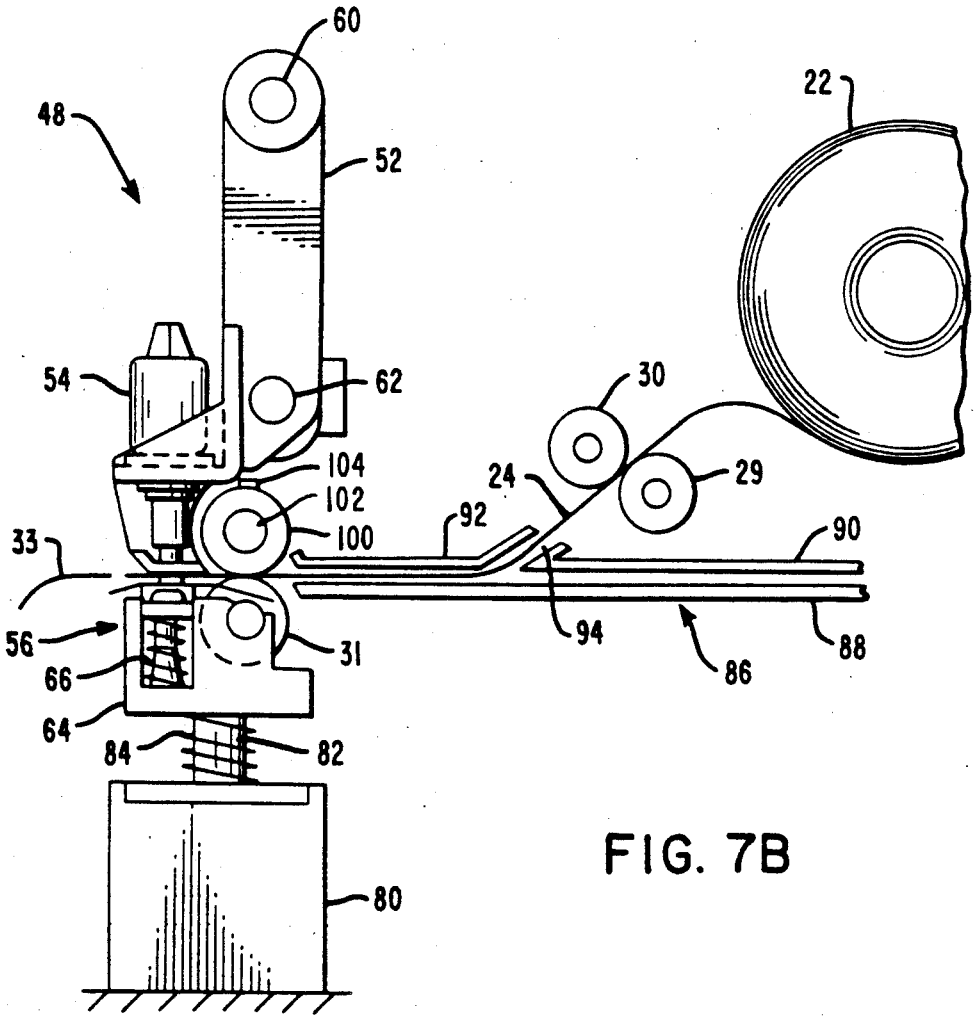

FIGS. 7A and 7B show portions of a printer having a conventional paper feeding mechanism. Since many of the parts of the mechanism are the same as the parts already described in FIGS. 5A and 5B, the same reference numerals are used for such parts in FIGS. 7A and 7B. The conventional mechanism has the receipt/slip printing station 48 including the platen assembly 56 and the carriage 52 and the print heads 54. The platen assembly 56 includes the feed roll 31 for feeding the receipt paper 24 or the slip 55 through the printing station 48.

FIGS. 7A and 7B illustrate a prior art arrangement that includes a pressure roll 100 having a shaft 102 journaled in bearings, as 104, in the sidewalls 44 and 46 of the printer 10. The bearing 104, on each side of the printer 10 is formed to fit for journaling the shaft 102 of the pressure roll 100. The pressure roll 100 is thus maintained in a position that is set relative to the carriage 52 and the print heads 54.

In the situation wherein a printing operation is completed on a slip 55, the solenoid 80 is energized, as shown in FIG. 7A, and the platen assembly is moved down to provide space for removal of the slip from between the feed roll 31 and the pressure roll 100. After removal of the slip 55 from the printing station 48, the receipt paper 24, which has been retracted into the entry guide structure 94, is advanced toward the printing station 48 and along the path formed by the main guide structure 86 by the feed rolls 29 and 30. After the receipt paper 24 has been positioned at the printing station 48, the solenoid 80 is deenergized and the platen assembly 56 is moved up by the spring 84 to the position shown in FIG. 7B. The receipt paper 24 is held in place by the feed roll 31 and the pressure roll 100 for the printing operation and a receipt 33 is then provided to the customer.

It is seen from FIG. 7A, that the leading edge of the receipt paper 24 is under the pressure roll 100 and adjacent the lower edge portion 98 of the carriage 52 and the ribbon 96. Due to the tendency of the receipt paper 24 to curl (FIG. 6A) in the manner as wound on the supply roll 22, the leading edge of the receipt paper 24 may contact the lower edge portion 98 of the carriage 52, the ends of the print wires of the print solenoids 54, or the ribbon 96. If the leading edge of the receipt paper 24 catches the ribbon 96, the ribbon may be turned over and a jam may occur. If printing is performed with a turned over ribbon, damage may occur to the ends of the print wires of the print solenoids 54 and cause poor printing. Also, if the leading edge of the receipt paper 24 is caught by the carriage 52, the print solenoids 54 or the ribbon 98, the receipt paper may jam. The frequency of such jam conditions increases with slack in the ribbon 96 which is worn and which is reduced in flexural rigidity, or with increased tendency of the receipt paper 24 to curl due to the reduced diameter of the supply roll 22 with usage of receipt paper 24 therefrom.

The structure of the present invention eliminates or substantially reduces the jam conditions of the receipt paper 24 or the ribbon 96 in the dot matrix printer 10. The bearings 70 and 72 with the elongated slots 74 and 76 allow the shaft 78 to move up and down in the elongated slots. The feed roll 31 is moved downward by actuation of the solenoid 80 to provide a space between the platen assembly 56 and the carriage 52. Downward movement of the platen assembly 56 allows the pressure roll 32 to move a predetermined amount and to change the path of the receipt paper 24 toward the printing station 48.

The arrangement of the paper feed mechanism of the present invention allows the pressure roll 32 to move by reason of gravity to a lower position relative to the receipt/slip printing station 48 and to change or alter the path of the receipt paper 24 as such receipt paper is driven toward the printing station 48. As a result of the change in the path of the receipt paper 24, the receipt paper does not contact the lower portion of the carriage 52 or the ribbon 96 and thereby eliminates jam conditions of the receipt paper 24 and/or the ribbon 96.

It is thus seen that herein shown and described is a compact dot matrix printer that includes a paper feed mechanism, wherein the feed roll is moved to provide a space between the platen and the print heads. Movement of the feed roll allows the opposed pressure roll to move down and guide the receipt paper toward and through the printing station. The apparatus and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A feed mechanism for record media in a dot matrix printer having spaced side walls and a printing station positioned between said side walls, said feed mechanism comprising a platen assembly supported by said side walls, printing means positioned in opposed manner to said platen assembly for printing on said record media, a feed roller operably associated with said platen assembly, a guide structure adjacent and along which said record media travels toward and through said printing station formed by said platen assembly and said printing means, means for moving said platen assembly in a direction from said printing means, and roller means movably journaled in said side walls and cooperating with said feed roller for advancing record media along said guide structure and in a path through said printing station, said platen assembly being movable to separate said feed roller from said printing means, and said roller means moving in the direction of said platen assembly to guide said record media in a path through said printing station to avoid contact with said printing means.

2. The feed mechanism of claim 1 wherein the roller means includes a pressure roller cooperating with said feed roller for advancing said record media through said printing station.

3. The feed mechanism of claim 1 including a bearing in each of said spaced side walls and said roller means includes a shaft movable in each of said bearings to permit movement of said roller means in a direction to and from said feed roller.

4. The feed mechanism of claim 3 wherein each of said bearings includes an elongated aperture for journaling said shaft and said shaft is movable in said aperture upon movement of said platen assembly and said feed roller.

5. The feed mechanism of claim 1 wherein said platen assembly includes a support structure for a platen and said feed roller is carried by said support structure.

6. The feed mechanism of claim 1 wherein said roller means includes a shaft, a bearing in each of said side walls for journaling said shaft, and an elongated slot disposed in each bearing for permitting said shaft to move up and down in said elongated slot in response to movement of said platen assembly.

7. In a printer having spaced side plates, printing means transversely movable between said side plates of said printer, and a platen assembly supported by said side plates and positioned in opposed manner to said printing means for printing operation on record media, the improvement comprising a feed mechanism for advancing said record media to said platen assembly and said printing means for printing on said media, said feed mechanism including a feed roller supported by said platen assembly and an opposed pressure roller operably associated with said feed roller, said side plates having bearing means for journaling said pressure roller, means for moving said feed roller in a direction to and from said pressure roller, said bearing means defining elongated slots therein for allowing said pressure roller to move in said direction relative to said feed roller as said feed roller is moved by said moving means whereby said pressure roller is movable to a predetermined position and guides said record media along a path to avoid contact with said printing means as said record media is advanced thereto.

8. In the printer of claim 7 wherein the pressure roller includes a shaft journaled in said elongated slots of said bearing means and moves a predetermined distance therein dependent upon movement of said platen assembly.

9. In the printer of claim 7 wherein said means for moving said feed roller comprises a solenoid energized to move said platen assembly from said printing means a predetermined distance and spring means operable to move said platen assembly toward said printing means upon deenergization of said solenoid.

* * * * *